US008770570B2

(12) United States Patent
Soga

(10) Patent No.: US 8,770,570 B2
(45) Date of Patent: Jul. 8, 2014

(54) SHEET PROCESSING DEVICE, IMAGE FORMING SYSTEM, AND SHEET PROCESSING METHOD

(75) Inventor: Shigefumi Soga, Aichi (JP)

(73) Assignee: Ricoh Company, Limited, Tokyo (JP)

( * ) Notice: Subject to any disclaimer, the term of this patent is extended or adjusted under 35 U.S.C. 154(b) by 122 days.

(21) Appl. No.: 13/400,168

(22) Filed: Feb. 20, 2012

(65) Prior Publication Data

US 2012/0223470 A1 Sep. 6, 2012

(30) Foreign Application Priority Data

Mar. 1, 2011 (JP) ..... 2011-043921

(51) Int. Cl.
*B65H 37/04* (2006.01)

(52) U.S. Cl.
USPC ..... 270/58.12; 270/58.11; 270/58.09

(58) Field of Classification Search
USPC ..... 270/58.08, 58.09, 58.11, 58.12
See application file for complete search history.

(56) References Cited

U.S. PATENT DOCUMENTS 5,098,074 A * 3/1992 Mandel et al. ..... 270/58.13
6,283,354 B1 * 9/2001 Hirota et al. ..... 227/39
6,382,615 B1 * 5/2002 Ishiguro et al. ..... 270/58.12
6,450,934 B1 * 9/2002 Coombs ..... 493/383
6,685,180 B2 * 2/2004 Saegusa et al. ..... 270/58.08
6,722,646 B2 * 4/2004 Sekiyama et al. ..... 270/58.09
6,746,008 B2 * 6/2004 Coombs et al. ..... 270/58.08
6,814,350 B2 * 11/2004 Saegusa et al. ..... 270/58.14
7,681,873 B2 3/2010 Tsutsui et al.
7,690,636 B2 * 4/2010 Noh ..... 270/58.12
7,744,085 B2 6/2010 Tsutsui et al.
7,922,164 B2 * 4/2011 Nakayama ..... 270/58.12
2007/0057441 A1 3/2007 Tsutsui et al.
2007/0138730 A1 6/2007 Tsutsui et al.
2010/0025910 A1 * 2/2010 Nakayama ..... 270/58.12

FOREIGN PATENT DOCUMENTS

JP 3399667 2/2003

OTHER PUBLICATIONS

English language abstract for JP-08-143211 which corresponds to JP-3399667.

* cited by examiner

*Primary Examiner* — Patrick Mackey
(74) *Attorney, Agent, or Firm* — Harness, Dickey & Pierce, P.L.C.

(57) ABSTRACT

A sheet processing device provided with a stacking unit configured to stack thereon one or more conveyed sheets, a staple unit configured to staple a bundle of sheets stacked on the stacking unit, a moving unit configured to move the staple unit to a staple position, and a projecting and retrieving unit configured to project and retrieve the stacking unit in a space overlapped with a motion space for the staple unit to move therein.

12 Claims, 9 Drawing Sheets

SHEET PROCESSING DEVICE, IMAGE FORMING SYSTEM, AND SHEET PROCESSING METHOD

CROSS-REFERENCE TO RELATED APPLICATIONS

The present application claims priority to and incorporates by reference the entire contents of Japanese Patent Application No. 2011-043921 filed in Japan on Mar. 1, 2011.

BACKGROUND OF THE INVENTION

1. Field of the Invention

The present invention generally relates to a sheet processing device, an image forming system, and a sheet processing method, and, more particularly, to a sheet processing device and an image forming system with a reduced space portion for a stacking unit, on which sheets are to be stacked when stapling is performed, and a sheet processing method to be performed in a sheet processing device and an image forming system.

2. Description of the Related Art

In an electrographic image forming apparatus, there is known a sheet finishing device capable of stapling, with a staple unit, at one or more predetermined positions on the accumulated sheets each of which are ejected from the body of the image forming apparatus and stacked temporarily on a so-called "staple tray". Conventionally, this type of sheet finishing device includes or a device capable of changing a direction of staple needle by rotating horizontally the staple unit in order to staple at one corner or one edge of bundle of sheets disposed on the staple tray inside of the device, a device capable of moving the staple unit along one edge of the bundle of sheets in order to staple plurality positions on the one edge, and the like.

For example, Japanese Patent No. 3399667 discloses a sheet processing device that requires no staple tray for stapling treatment, in order to downsize the device.

Japanese Patent No. 3399667 intends to simplify and downsize the mechanism of the sheet processing device (sheet finishing device) having a staple function. And, for the purpose of continuous stapling operations, the device is provided with a sheet eject tray that moves up and down depending on the stack amount of the sheets thereon, an auxiliary tray disposed between the sheet eject tray and a sheet eject roller to eject the sheet onto the sheet eject tray and movable with respect to the device body in parallel to the sheet conveying direction between a position covering above a portion near the base of the sheet eject tray and a position retrieved from the above position, and a staple unit disposed aside of the auxiliary tray and capable of staple the bundle of sheets while reciprocating in a direction orthogonal to the sheet width direction.

However, the sheet processing device (sheet finishing device) having stapling function for plurality positions needs (i) to maintain a space allowing the movement of the staple unit in the case of two position stapling which requires the movement of the staple unit, and (ii) to maintain a wider space on the tray in order to ensure the accurate function of align roller or jogger fences to align the sheets for the purpose of ensuring the alignment quality of the bundle of sheets stacked on the staple tray. Therefore, the conventional sheet processing device maintains the space allowing the movement of the staple unit and the space for the layout of rollers and fences on the tray. Thereby, it is difficult to downsize this type of conventional sheet processing device. Specifically, it is very difficult to maintain these spaces in the limited space of the inner-body sheet processing device, for example.

On the other hand, the device disclosed by Japanese Patent No. 3399667 realizes the downsizing of the device while maintaining the staple function. However, the device is not configured to allow the movement of the staple unit inward the device to realize the two position stapling. Furthermore, the staple tray is an auxiliary tray capable of projecting toward and retrieving from the sheet eject tray. Thereby, if the area of the staple tray increases, the staple tray covers a space above the sheet eject tray. Specifically, in the case of the inner-body sheet eject tray, the movable range thereof in the vertical direction is limited. As a result, a maximum stack amount on the sheet eject tray reduces in the case of the sheet processing unit employing the fixed tray. On the other hand, if the area of the staple tray reduces, it becomes difficult to satisfy the accuracy in the alignment for stapling, since the alignment roller becomes difficult to be disposed at the optimum position and since the alignment in the width direction by jogger fences becomes almost impossible.

There is a need to present a sheet processing device capable of maintaining a space for the movement of the staple unit, and capable of maintaining a space for the layout on the staple tray to satisfy the alignment accuracy for stapling.

SUMMARY OF THE INVENTION

It is an object of the present invention to at least partially solve the problems in the conventional technology.

A sheet processing device is provided with a stacking unit configured to stack thereon one or more conveyed sheets, a staple unit configured to staple a bundle of sheets stacked on the stacking unit, a moving unit configured to move the staple unit to a staple position, and a projecting and retrieving unit configured to project and retrieve the stacking unit in a space overlapped with a motion space for the staple unit to move therein.

An image forming system is provided with a sheet processing device, and an image forming apparatus configured to form an image on a sheet. The sheet processing device includes a stacking unit configured to stack thereon one or more conveyed sheets, a staple unit configured to staple a bundle of sheets stacked on the stacking unit, a moving unit configured to move the staple unit to a staple position, and a projecting and retrieving unit configured to project and retrieve the stacking unit in a space overlapped with a motion space for the staple unit to move therein.

A sheet processing method capable of realizing one-position parallel stapling, one-position slanted stapling, and two-position stapling is implemented by a sheet processing device which includes a stacking unit configured to stack thereon one or more conveyed sheets, a staple unit configured to staple a bundle of sheets stacked on the stacking unit, a moving unit configured to move the staple unit to a staple position, and a projecting and retrieving unit configured to project and retrieve the stacking unit in a space overlapped with a motion space for the staple unit to move therein. The method includes projecting maximally the stacking unit by the projecting and retrieving unit, and disposing the staple unit at a first staple position located outside of the motion space, when stacking the sheets on the stacking unit. If the one-position parallel stapling is to be performed, the bundle of sheets is stapled at the first staple position, after projecting maximally the stacking unit and disposing the staple unit at the first staple position in the preceding steps. If the one-position slanted stapling is to be performed, the staple unit is rotated by an angle corresponding to a staple angle for the slanted stapling, the stacking unit is retrieved by the projecting and retrieving unit to a position where the stacking unit does not hinder a rotation of the staple unit, and the bundle of sheets are stapled at a second staple position, after projecting maximally the stacking unit and disposing the staple unit at the first staple position in the preceding steps. If the two-position stapling is to be performed, the staple unit is rotated to a position where a staple needle of the staple unit becomes parallel to a rear end of the bundle of sheets, the staple unit is retrieved maximally by the projecting and retrieving unit to a position where the stacking unit does not hinder the motion of the staple unit, and the bundle of sheets is stapled at a third staple position and a fourth staple position, after projecting maximally the stacking unit and disposing the staple unit at the first staple position in the preceding steps.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 7A to 7D are explanatory diagrams of stapling operations and illustrates a tray portion of the sheet finishing apparatus as viewed from above, in which FIG. 7A illustrates a state where a received sheet is stacked on a staple tray and caused to abut on a rear end reference fence by an alignment roller, FIG. 7B illustrates a state where, after a designated number of sheets has been stacked, stapling is performed in a position for slanted stapling, FIG. 7C illustrates a state where, after the designated number of sheets has been stacked, stapling is performed in a near-side position of two-position stapling, and FIG. 7D illustrates a state where, after the designated number of sheets has been stacked, stapling is performed in a far-side position of the two-position stapling;

DETAILED DESCRIPTION OF THE PREFERRED EMBODIMENTS

Figure 1:
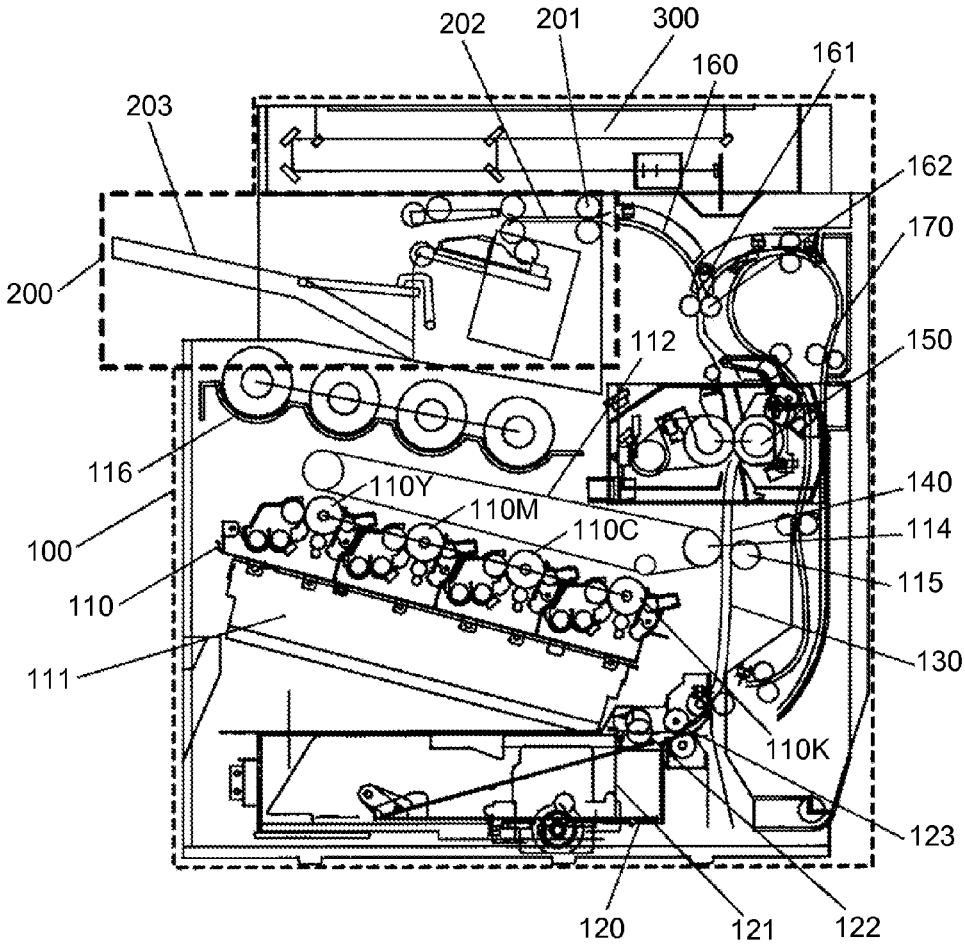
FIG. 1 is a diagram schematically illustrating a system configuration of an image forming system according to an embodiment of the present invention.

According to an embodiment of the present invention, a sheet processing device having a stapling function for multiple positions realizes a layout in which a space for maintaining a length required for the staple tray to align the sheets thereon, and a space required for the movement of the staple unit are overlapped partially. And, the overlapped space is used exclusively by the staple tray and the staple unit.

Exemplary embodiments of the present invention are described below with reference to the accompanying drawings.

In the embodiments described below, a sheet corresponds to reference numeral and symbol P or P-100, P-101; a bundle of sheets corresponds to P-102, P-103; a stacking unit corresponds to a staple tray 210; a staple unit corresponds to a staple unit 215; a moving unit corresponds to a rail 217, a stapling moving motor 223, a driving pulley 223*a*, a driven pulley 223*b*, and a timing belt 223*c*; an projecting and retrieving unit corresponds to a driving section 229, a gear 228, and a rack 227; a fixed tray corresponds to reference numeral and symbol 226*a*; a movable tray corresponds to reference numeral and symbol 226*b*; a first alignment unit corresponds to a rear end reference fence 220; a abut member corresponds to a alignment roller 211; a space for the movement corresponds to reference symbol A; a first stapling position corresponds to position B1; a second alignment unit corresponds to a pair of jogger fences 212 including a fixed portion 212*a* and a movable portion 212*b*; a second stapling position corresponds to position B2; a third stapling position corresponds to position B3; a fourth stapling position corresponds to position B4.

FIG. 1 is a diagram schematically illustrating a system configuration of an image forming system according to an embodiment of the present invention. Referring to FIG. 1, the image forming system according to the embodiment includes an image forming apparatus 100, a sheet processing device 200, and an image scanning apparatus 300.

The image forming apparatus 100 is a tandem color image forming apparatus using an indirect transfer method. The image forming apparatus 100 includes, at a substantially center portion in FIG. 1, an image forming unit 110 having four color image forming stations 110Y, 110M, 110C, and 110K, an optical writing unit 111 disposed below and adjacent to the image forming unit 110, a sheet feeding unit 120 disposed below the image forming unit 110, a sheet-feed conveying path (vertical conveying path) 130 that conveys a sheet picked up from the sheet feeding unit 120 to a secondary transfer unit 140 and a fixing unit 150, a discharge path 160 that conveys a sheet, onto which an image is fixed, to the sheet processing device 200, and a duplex printing conveying path 170 that turns a sheet, on one side of which an image is formed, upside down so that an image is formed on the other side.

The image forming unit 110 includes photosensitive drums for colors Y, M, C and K respectively in the respective image forming stations 110Y, 110M, 110C and 110K. Around respective photosensitive drum, there are provided with an electrostatic charging unit, a developing unit, a primary transfer unit, a cleaning unit, and a neutralizing unit. The image forming unit 110 also includes an intermediate transfer belt 112 onto which images formed on respective drums are intermediately transferred by the primary transfer unit. Respective photosensitive drums are irradiated with laser from the optical writing unit 111, so that each color image is written on the surface of each drum.

The optical writing unit 111 is disposed below the image forming unit 110. The intermediate transfer belt 112 is disposed above the image forming unit 110.

The intermediate transfer belt 112 is rotatably supported by a plurality of support rollers. A support roller 114, which is one of the support rollers, faces a secondary transfer roller 115 via the intermediate transfer belt 112 in the secondary transfer unit 140 so that secondary transfer of an image from the intermediate transfer belt 112 onto a sheet can be performed. Reference numeral 116 denotes a toner container arranged in an exchangeable manner.

Meanwhile, an image forming process to be performed by a tandem color image forming apparatus using an indirect transfer method is known and does not have direct relation with the scope of the present invention; accordingly, detailed description is omitted.

The sheet feeding unit 120 includes a sheet feed tray 121, a pickup roller 122, and sheet-feed conveying rollers 123. The sheet feeding unit 120 picks up a sheet from the sheet feed tray 121 and delivers the sheet upward along the vertical conveying path 130. The delivered sheet, onto which an image is transferred in the secondary transfer unit 140, is delivered to the fixing unit 150. The fixing unit 150 includes a fixing roller and a pressure roller. During a course where the sheet passes through a nip between the fixing roller and the pressure roller, heat and pressure are applied to the sheet, causing toner to be fixed onto the sheet.

Downstream of the fixing unit 150, there are provided with the discharge path 160 and the duplex printing conveying path 170, into which bifurcation is made at a split flap 161. A path is selected depending on whether a sheet is to be conveyed to the sheet processing device 200 or to the duplex printing conveying path 170. Meanwhile, bifurcation conveying rollers 162 are provided immediately upstream of the split flap 161 on an upstream side in a sheet conveying direction to apply a conveying force to the sheet.

The sheet processing device 200 is arranged inside the image forming apparatus 100 and performs predetermined processing on a sheet, on which an image has been formed, delivered from the image forming apparatus 100 and stacks the sheet on a discharge tray 207 positioned most downstream. The sheet processing device 200 is what is called as a sheet finishing apparatus that performs predetermined processing on a sheet, on which an image has been formed. Details about the sheet processing device 200 will be described later.

The image scanning apparatus 300 is of a known type that optically scans an original placed on an exposure glass to read an image on a surface of the original. The configuration and function of the image scanning apparatus 300 are known and do not have direct relation with the scope of the present invention; accordingly, detailed description is omitted.

In the image forming apparatus 100 configured as roughly described above, image data for use in writing is generated from data pertaining to an original obtained by scanning by the image scanning apparatus 300 or print data transferred from an external PC or the like, and the optical writing unit performs optical writing on the photosensitive elements on the basis of the image data. Images formed at the image forming stations on a per-color basis are sequentially transferred onto the intermediate transfer belt 112 to thereby form a color image, in which four color images are superimposed, on the intermediate transfer belt 112.

Meanwhile, a sheet is delivered from the sheet feed tray 121 according to the image formation. The sheet is temporarily stopped at a position of registration rollers (not shown) immediately upstream of the intermediate transfer unit 140 to be delivered toward the secondary transfer unit 140 in a synchronized timing with a leading edge of image on the intermediate transfer belt 112. The sheet onto which the image is transferred at the intermediate transfer unit 140 is conveyed to the fixing unit 150. After the image is fixed at the fixing unit 150, the sheet is delivered to the discharge path 160 by the switching operation of the split flap 161 in the case of one-side printing or the case after completion of double-side printing. On the other hand, the sheet is delivered to the duplex printing conveying path 170 in the case after one-side printing of double-side printing. The sheet conveyed into the duplex printing conveying path 170 is turned upside down, and thereafter delivered into the intermediate transfer unit 140 again where an image is formed on the other side of the sheet. Thereafter, the sheet is conveyed to the discharge path 160. The sheet delivered to the discharge path 160 is conveyed to the sheet processing device 200. The sheet having undergone predetermined sheet processing or no processing in the sheet processing device 200 is discharged onto the discharge tray 207.

Figure 2:
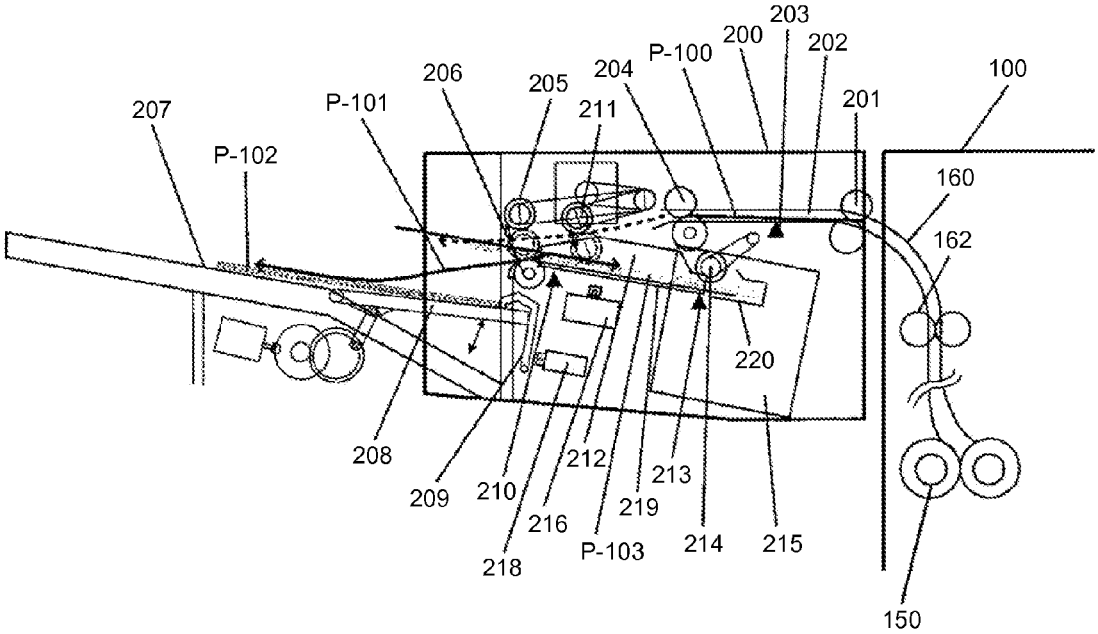
FIG. 2 is a schematic configuration diagram of a sheet processing device illustrated in FIG. 1.

FIG. 2 is a schematic view of the sheet processing device 200 illustrated in FIG. 1. The sheet processing device 200 includes, as a finishing function, a stapling mechanism and a shift mechanism. Meanwhile, the sheet processing device itself means a device for performing a predetermined processing on a sheet. The sheet processing device is also referred to as a sheet finishing apparatus when performing its function as being connected to the downstream of the image forming apparatus 100 or another sheet processing device. In this specification, the sheet finishing apparatus may be also referred to as the sheet processing device in general.

Referring to FIG. 2, the sheet processing device 200 includes a pair of inlet rollers 201, a discharge conveying path 202, a pair of shift discharge rollers 204, the staple tray 219, the alignment roller 211, a back roller 214, the rear end reference fence 220, the jogger fence (aligning plate) 212, a discharge roller 206, and the discharge tray 207 that are arranged in this order from upstream in the sheet conveying direction.

Specifically, at a sheet receiving portion of the sheet processing device 200, there are provided with the pair of inlet rollers 201 that receives a sheet from the discharge conveying path 160 of the image forming apparatus 100; the discharge conveying path 202 through which the received sheet is conveyed to the pair of shift discharge rollers 204; and the pair of shift discharge rollers 204 that serves as a shift unit having a function of shifting sheets and discharging the shifted sheets to the discharge tray 207. The sheet is conveyed along the discharge conveying path 202 (indicated by P-100 in FIG. 2) by causing the pair of inlet rollers 201 and the pair of shift discharge rollers 204 to rotate with an inlet motor (not shown).

An inlet sensor 203 is arranged on the discharge conveying path 202. The inlet sensor 203 detects a front end and a rear end of a sheet. Based on (i) the detected timing of the front end and the rear end and (ii) the driving step numbers of the discharge motor 216 (to be described later) and the inlet motor which are stepping motors, the inlet sensor 203 determines the timing for performing various processing.

Meanwhile, the pair of inlet rollers 201 and the pair of shift discharge rollers 204 that are arranged along the discharge conveying path 202 function as a conveying unit.

As the sheet discharge mode, there are a shift mode for shifting and ejecting the sheet or sheets, and a staple mode for stapling and ejecting a stack of sheets. The shift mode is a mode in which the sheet or sheets are ejected to the discharge tray 207 without ejected to the staple tray 219 (P-101 in FIG. 2). This mode is not related directly to the embodiment. Thereby the explanation of the shift mode is omitted and the following explanation is focused on the staple mode with detail of respective configurations.

The staple mode is a mode in which a predetermined number of sheets are stapled with stapler and ejected.

The alignment roller 211 that is to be driven up and down by a stepping motor (not shown) is arranged between the pair of shift discharge rollers 204 arranged at the most downstream end portion of the discharge conveying path 202 and a discharge guide plate 205 arranged immediately upstream of a discharge tray 208 in a sheet discharge direction. The alignment roller 211 includes a lever portion that moves up and down; and a roller portion. The roller portion is rotated by the discharging motor 216 in a direction opposite to the sheet conveying direction.

In the staple mode, at a time when a rear end of a sheet has passed through the pair of shift discharge rollers 204, the alignment roller 211 is lowered, causing the roller portion to press the sheet against the staple tray 219 serving as the stacking unit. Furthermore, the roller portion is rotated to move the sheet in reverse until the rear end of the sheet abuts on the (rear end) reference fence 220. In addition, the back roller 214 that is driven by the inlet motor (not shown) is arranged above the reference fence 220. The back roller 214 assists the switch back operation for moving the sheet in reverse and performs sheet alignment in the sheet conveying direction. This sheet alignment is performed with reference to the reference fence 220 by causing the rear end of the sheet to abut on the reference fence 220 (P-103 in FIG. 2).

Figure 7A:
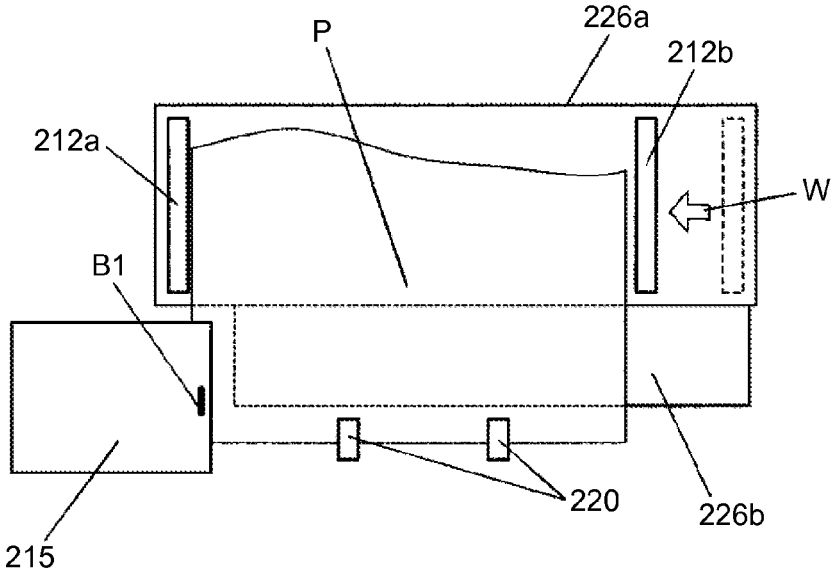

When the switch back operation is completed, the jogger fence 212 arranged on the staple tray 219 performs sheet alignment in a direction orthogonal to the sheet conveying direction. As illustrated in FIG. 7A to be described later, the jogger fence 212 includes the fixed portion 212*a* and a movable portion 212*b*. The movable portion 212*b* moves in the direction (direction indicated by arrow w) orthogonal to the sheet conveying direction to bring an end of the sheet P into contact with the fixed portion 212*a* to align the sheet P with a reference position defined by the fixed portion 212*a*, thereby performing sheet alignment.

At this time, a side of a trailing edge area of the sheet is inserted into a stapling position where a staple needle is pressed by the stapler 215 serving as the staple unit. After the conveying operation, the operation of moving a sheet in reverse, and the sheet aligning operation for a designated number of sheets are completed, the sheets are stapled. Thus, in the present embodiment, the reference fence 220 and the jogger fence 212 function as the alignment units.

After the stapling, the discharge guide plate 205 is lowered as indicated by dashed lines in FIG. 2, causing the bundle of sheets to be pinched between the discharging roller 206 and a following roller attached to the discharge guide plate 205. The discharging motor 216 is driven to discharge the bundle of sheets onto the discharge tray 208. The discharging motor 216 is driven for a predetermined number of steps after the bundle of sheets is started to be ejected or discharged. Thereafter, a solenoid 218 is switched on to release a sheet retainer 209 to further lower the discharge tray 208 by a predetermined distance. Subsequently, at a time when the rear end of the bundle of sheets has passed through a bundle discharge sensor 210, the discharge guide plate 205 is raised, and the discharging motor 216 is stopped to prepare for receiving a next sheet. At the same time, the solenoid 218 is switched off to retain the sheets (P-102 in FIG. 2). Reference numeral 213 denotes a sheet-presence detection sensor that detects whether a sheet is present on the staple tray 219.

Figure 3:
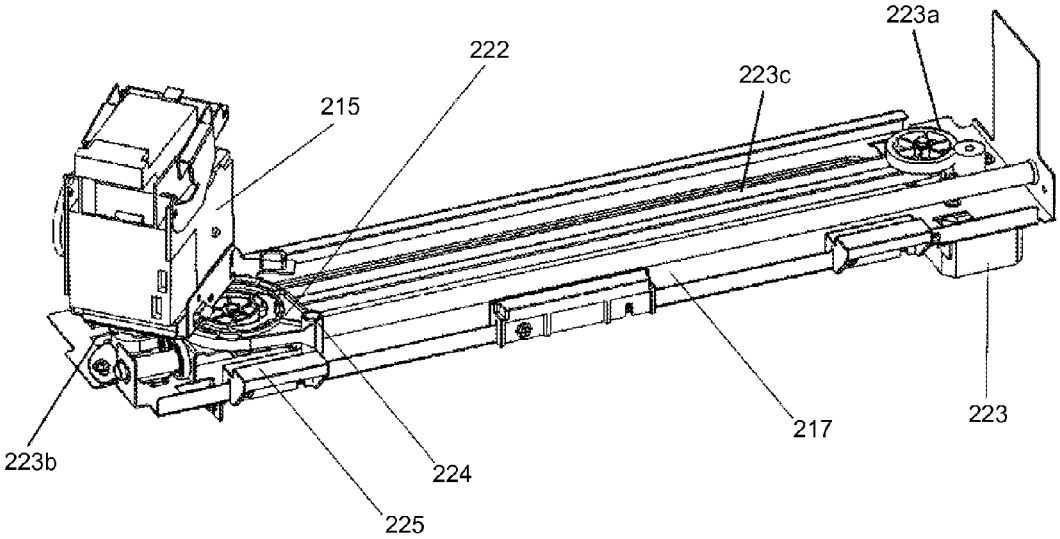
FIG. 3 is a perspective view illustrating the configurations of a staple unit and a moving unit for the staple unit according to the embodiment.

FIG. 3 is a perspective view illustrating the configurations of the staple unit and the moving unit for the staple unit according to the embodiment.

Referring to FIG. 3, the moving unit for the staple unit 215 is located below the staple unit 215 in FIG. 2 and includes a rail 217 that slidably supports the staple unit 215, a stapling moving motor 223 that moves the staple unit 215 along the rail 217, a pair of driving pulley 223*a* driven by the stapling moving motor 223 and the following pulley 223*b* which are arranged on opposite ends of the rail 217, and the timing belt 223*c* stretched between the pulleys 223*a* and 223*b*. The timing belt 223*c* is mounted parallel to the rail 217.

The staple unit 215 is disposed on a rotating stage 222 and includes a mechanism for performing horizontal rotation as a result that, in a course of traveling on the rail, a protrusion 224 of the rotating stage 222 comes into contact with a hook member 225 to be caught thereon. Together with the rotating stage 222, the staple unit 215 is mounted on the rail 217. The rotating stage 222 is attached to the timing belt 223. Accordingly, activating the stapling moving motor 223 causes the timing belt 223 to rotate, causing linear motion along the rail 217 to occur.

This configuration makes it possible to change a stapling angle at which the staple needle is pressed by horizontally rotating the staple unit 215; therefore, stapling can be performed in different orientations, such as longitudinal orientation, lateral orientation, and slanted orientation. By activating the staple unit moving motor 223 to cause the staple unit 215 to linearly travel along the rail 217, stapling in a plurality of positions, such as end stapling and two-position stapling, can be performed.

Note that in the present embodiment, the staple tray 219 is provided above the rail 217 in most instances. Accordingly, the staple unit 215 is allowed to travel and rotate only when a space is provided above the rail 217 after sheet(s) has been stacked on the staple tray 219 and the movable tray portion of the staple tray 219 has been housed.

Meanwhile, a mechanism for carrying out the rotation is not limited to the mechanism described above, and any other configuration for carrying out the rotation by using a cam mechanism, a motor mechanism, or the like, can be employed.

Figure 4:
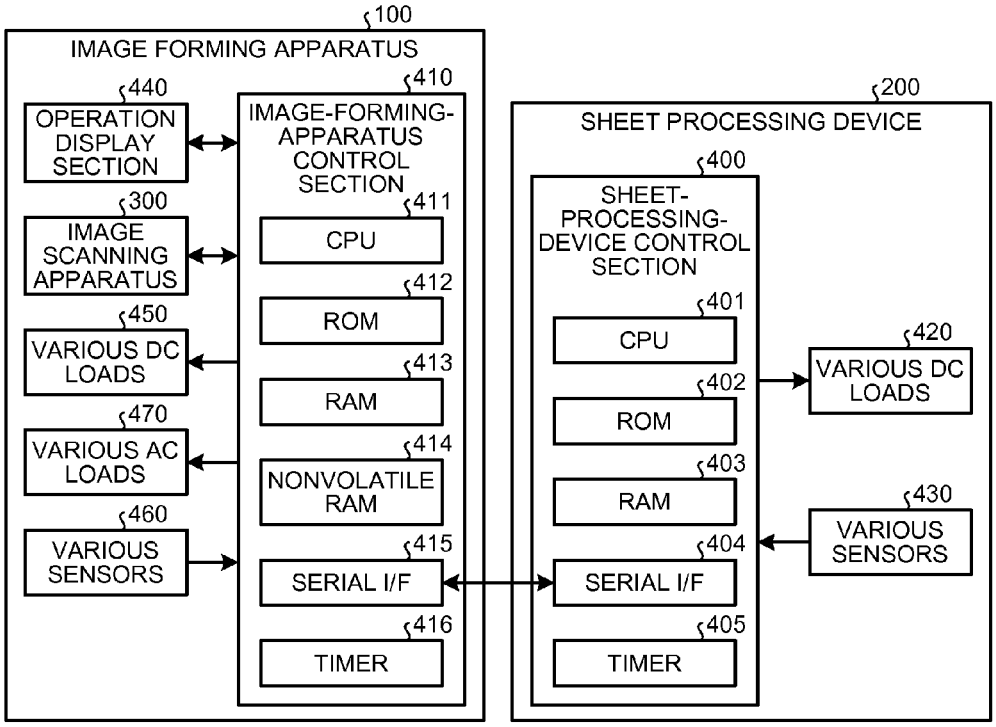
FIG. 4 is a block diagram illustrating a control structure related to conveyance control for an image forming apparatus and the sheet processing device.

FIG. 4 is a block diagram illustrating a control structure related to conveyance control for the image forming apparatus 100 and the sheet processing device 200 according to the present embodiment.

Referring to FIG. 4, control of the image forming apparatus 100 is performed by an image-forming-apparatus control section 410 that internally includes a central processing unit (CPU) 411, read only memory (ROM) 412, random access memory (RAM) 413, non-volatile RAM 414, a serial interface (I/F) 415, and a timer 416.

Program codes for the control are stored in the ROM 412. The CPU 411 loads the program codes into the RAM 413, stores data necessary for the control in the RAM 413, and executes control processing defined by the program codes while using the RAM 413 as a working area.

Various direct-current (DC) loads 450 and various alternating-current (AC) loads 470, such as a motor for use by the image forming unit 110 including the photosensitive elements, various motors or clutch(s) for the sheet feeding unit 120, the sheet-feed conveying path 130, and the duplex printing conveying path 170, and various sensors 460, such as a temperature sensor that detects a temperature of the fixing roller, are connected to the image-forming-apparatus control section 410. The image scanning apparatus 300 and an operation display section 440 are also connected to the image-forming-apparatus control section 410, and control of sections is performed via the image-forming-apparatus control section 410.

Control of the sheet processing device 200 is performed by a sheet processing device control section 400 that internally includes a CPU 401, ROM 402, RAM 403, a serial I/F 404, and a timer 405. Program codes for the control are stored in the ROM 402. The CPU 401 loads the program codes into the RAM 403, stores data necessary for the control in the RAM 403, executes control processing defined by the program codes while using the RAM 403 as a working area, and controls various DC loads 420.

The image forming apparatus 100 and the sheet processing device 200 exchange commands necessary for the sheet conveyance control via the serial I/Fs 415 and 404. The sheet processing device 200 performs the sheet conveyance control and post processing (finishing process) on the basis of the commands and information about a sheet position obtained from various sensors 430.

Figure 5A:
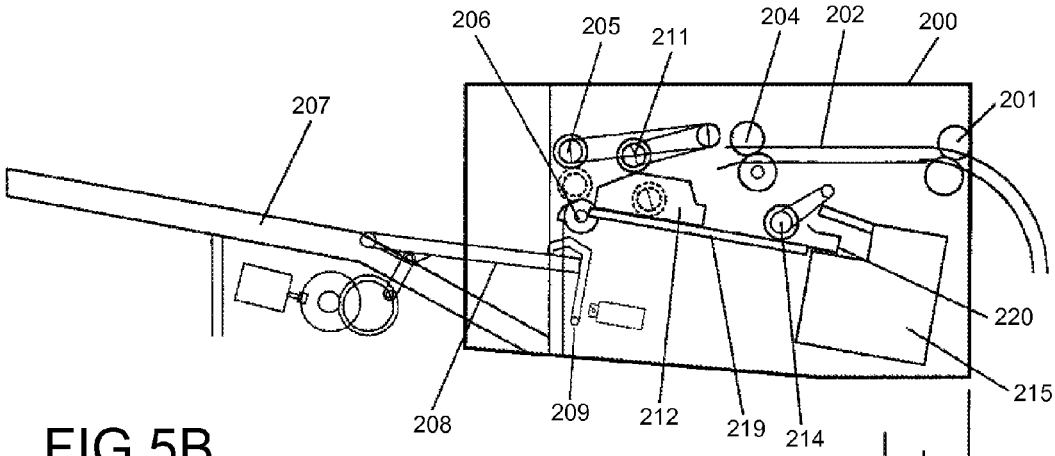
FIGS. 5A and 5B are diagrams for comparing a layout of a conventional sheet finishing device (sheet processing device) with a layout of the embodiment.
Figure 5B:
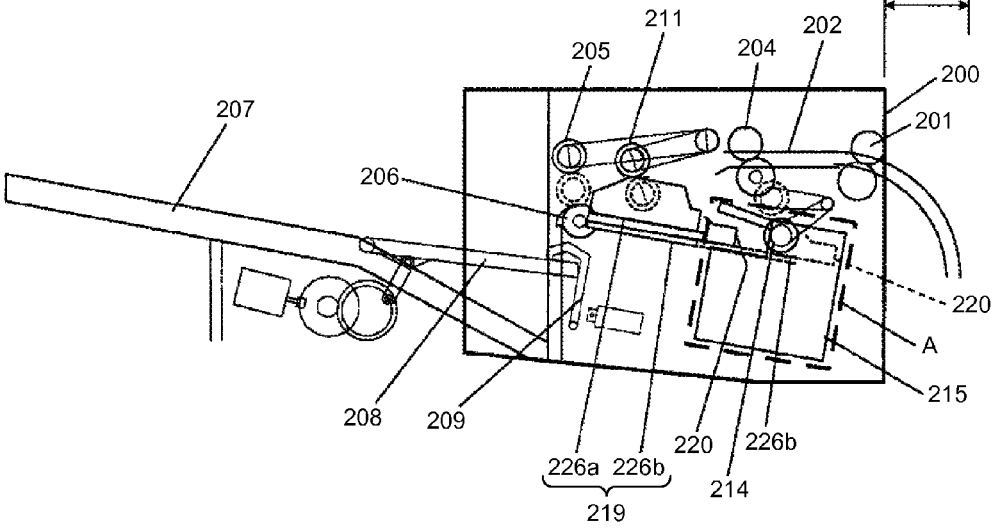

FIGS. 5A and 5B shows a comparison of layout of sheet processing device between the present embodiment and the conventional device. FIG. 5A illustrates the conventional sheet finishing apparatus, while FIG. 5B illustrates the sheet finishing apparatus according to the embodiment. They differ from each other in the structure of the staple tray. More specifically, the staple tray 219 illustrated in FIG. 5A is arranged such that an entire necessary area is fixed, and the staple unit 215 is arranged on a sheet-rear-end side of the staple tray 219. In contrast, the staple tray according to the embodiment illustrated in FIG. 5B includes two trays, or, more specifically, the fixed tray 226*a* and the movable tray 226*b*. When being housed, the movable tray 226*b* is housed under the fixed tray 226*a*, while, in a projecting state, the movable tray 226*b* is moved into the stapling motion space A as indicated by dashed lines in FIG. 5B to function in one piece with the fixed tray 226*a* as the staple tray 219. Meanwhile, the motion space A is a virtual zone that extends in the depth direction of FIG. 5B, or in x direction in FIG. 7D, which will be described later, to correspond to a path of traveling of the staple unit 215.

The rear end reference fence 220 that aligns rear ends, relative to the sheet conveying direction (leftward direction in FIG. 5B, of sheets stacked on the staple tray 219 is fixed to the movable tray 226*b* so that the rear end reference fence 220 moves in one piece with the movable tray 226*b*. In FIG. 5B, the level of a top surface of the movable tray 226*b* is lower than the level of a top surface of the fixed tray 226*a*, and therefore a step is undesirably produced on a sheet stacking surface. Accordingly, a configuration where a slit extending in a direction, in which the movable tray 226*b* moves, is provided in the fixed tray 226*a* and a rib that just fits in the slit is provided on the movable tray 226*b* may preferably be employed. This configuration allows making the sheet stacking surface flat because, even when the movable tray 226*b* is in the projecting state, the top surface of the movable tray 226*b* is increased in height by the rib.

As described above, using the staple tray 219 according to the present embodiment that includes the fixed tray 226*a* and the movable tray 226*b* reduces the length required only for the staple tray as compared with the conventional configuration. This allows size reduction by, in a case of an apparatus such as that illustrated in FIG. 5B, a portion corresponding to a length L.

Figure 6A:
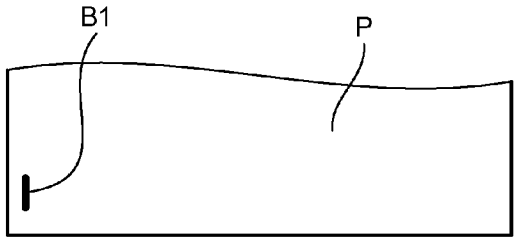
FIGS. 6A to 6C are explanatory diagrams illustrating positions in which the sheet finishing apparatus can perform stapling.
Figure 6B:
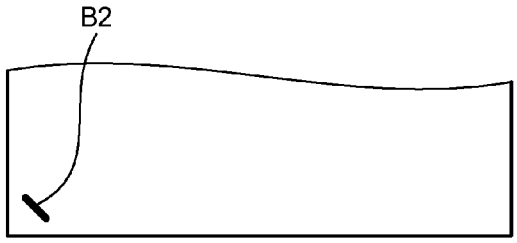
Figure 6C:
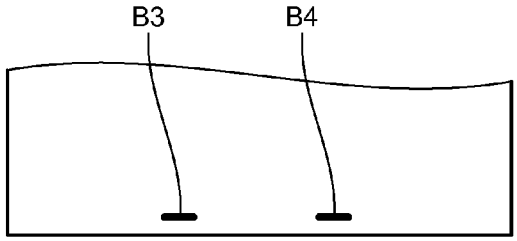

FIGS. 6A to 6C are explanatory diagrams illustrating positions in which the sheet processing device (the sheet finishing device) according to the embodiment can perform stapling. FIGS. 6A to 6C illustrate the sheet P in a state where the sheet P is placed on the staple tray 219 and caused to abut on the rear end reference fence 220; B1 to B4 indicate positions where the staple unit 215 can perform stapling.

FIG. 6A is a diagram illustrating "one-position parallel stapling". In the one-position parallel stapling, stapling is performed only in one position, which is the position B1 in this example, so as to orient a staple needle in parallel to a side of sheets as illustrated in FIG. 6B. For this stapling, the staple unit 215 does not travel.

FIG. 6B is a diagram illustrating "one-position slanted stapling". In the one-position slanted stapling, stapling is performed only in one position, which is the position B2 in this example, so as to orient the staple needle at 45 degrees relative to a rear end of a sheet as illustrated in FIG. 6B. For this stapling, the staple unit 215 is rotated on the rotating stage 222. This rotation is performed as described above with reference to FIG. 3. Specifically, the staple unit 215 rotates when the protrusion 224 abuts against the hook member 225 in the course of moving on the rail and thereby forced to move despite a condition that the longitudinal position thereof is restricted. The rotational angle is based on the travel distance after the protrusion 224 abuts against the hook member 225. FIG. 3 illustrates a state where the staple unit 215 has rotated 45 degrees. When the staple unit 215 is further moved from this state in the rightward direction in FIG. 3, the staple becomes parallel to the rear end of the sheet.

FIG. 6C is a diagram illustrating "two-position stapling". In the two-position stapling, stapling is performed in two positions, which are the positions B3 and B4 in this example, so as to orient the staple needle in parallel to the rear end of the sheet as illustrated in FIG. 6C. For this stapling, the staple unit 215 is further rotated from the state illustrated in FIG. 3 to be parallel with the rear end of the sheet. Thereafter, the staple unit 215 travels to the position B3 and the position B4 and performs stapling.

FIGS. 7A to 7D are explanatory diagrams of stapling operations and illustrates a tray portion of the sheet finishing apparatus as viewed from above.

FIG. 7A illustrates a state where the received sheet P is stacked on the staple tray 219 and caused to abut on the rear end reference fence 220 by the alignment roller 211. At this time, the movable tray 226*b* is in a state projecting to a position illustrated in FIG. 7A so as to maximize the sheet stacking surface. The staple unit 215 is on standby at a position illustrated in FIG. 7A and does not move until the number of stacked sheets reaches the designated number. This position is a home position for the staple unit 215. A staple needle B1 is to be inserted parallel to a side end of the sheet P.

Thereafter, stapling is to be performed at a time when the number of stacked sheets has reached the designated number. If stapling is to be performed in the position B1 of FIG. 6A, the staple unit 215 performs stapling at the standby position without traveling therefrom. Accordingly, the movable tray 226*b* also does not move because withdrawal is unnecessary.

Figure 7B:
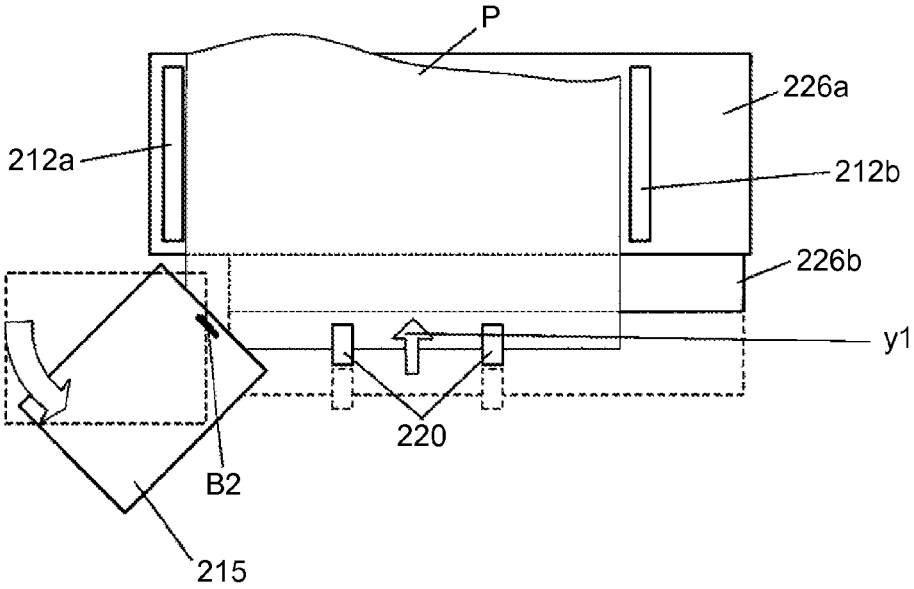

FIG. 7B is a diagram illustrating a state where, after the designated number of sheets P has been stacked, stapling is to be performed in the position B2. The staple unit 215 performs the rotation of 45 degrees from the home position and simultaneously causes the movable tray 226*b* to withdraw to an appropriate position. The staple unit 215 performs stapling in the position B2. A mechanism for withdrawal of the movable tray 226*b* will be described later with reference to FIGS. 9A and 9B.

Figure 7C:
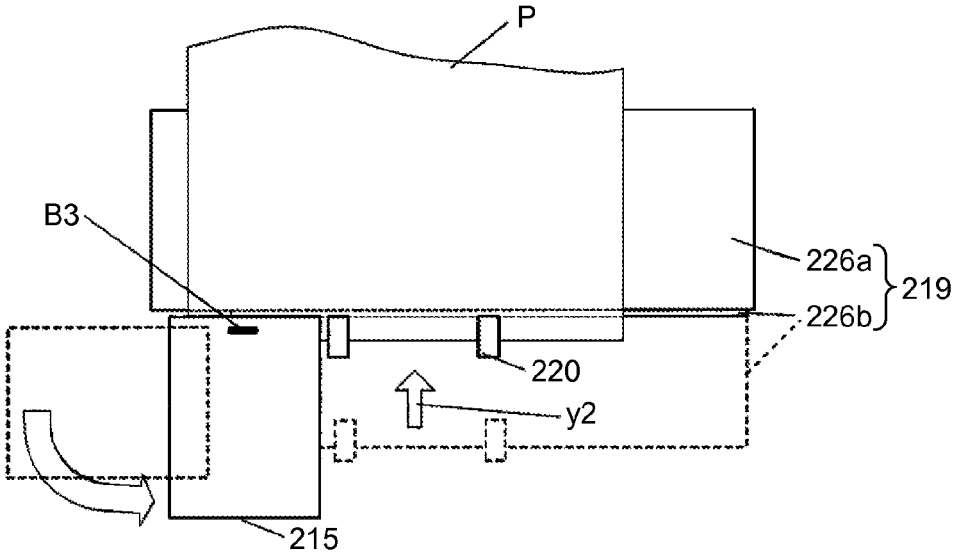
Figure 7D:
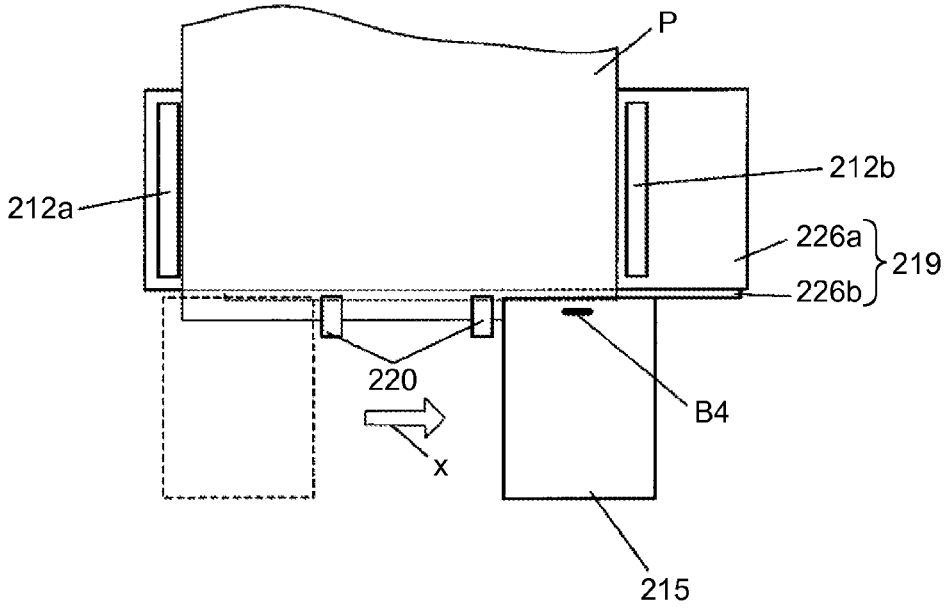

FIGS. 7C and 7D illustrate states where, after the designated number of sheets P has been stacked, stapling is to be performed in the positions B3 and B4, respectively. As illustrated in figures, the staple unit 215 performs the rotation of 90 degrees from the home position and simultaneously causes the movable tray 226*b* to withdraw to a most-housed position (in a direction indicated by arrow y). As a result, a space where the staple unit 215 can travel is provided. The staple unit 215 travels in the provided motion space along the rear end of the sheet P (in the direction indicated by arrow x) as illustrated in FIG. 7D to perform stapling in the positions B3 and B4.

Meanwhile, the position B1 corresponds to position for one-position parallel stapling; the position B2 corresponds to position for the one-position slanted stapling; the position B3 corresponds to near-side position for the two-position stapling; the position B4 corresponds to far-side position for the two-position stapling.

Figure 8:
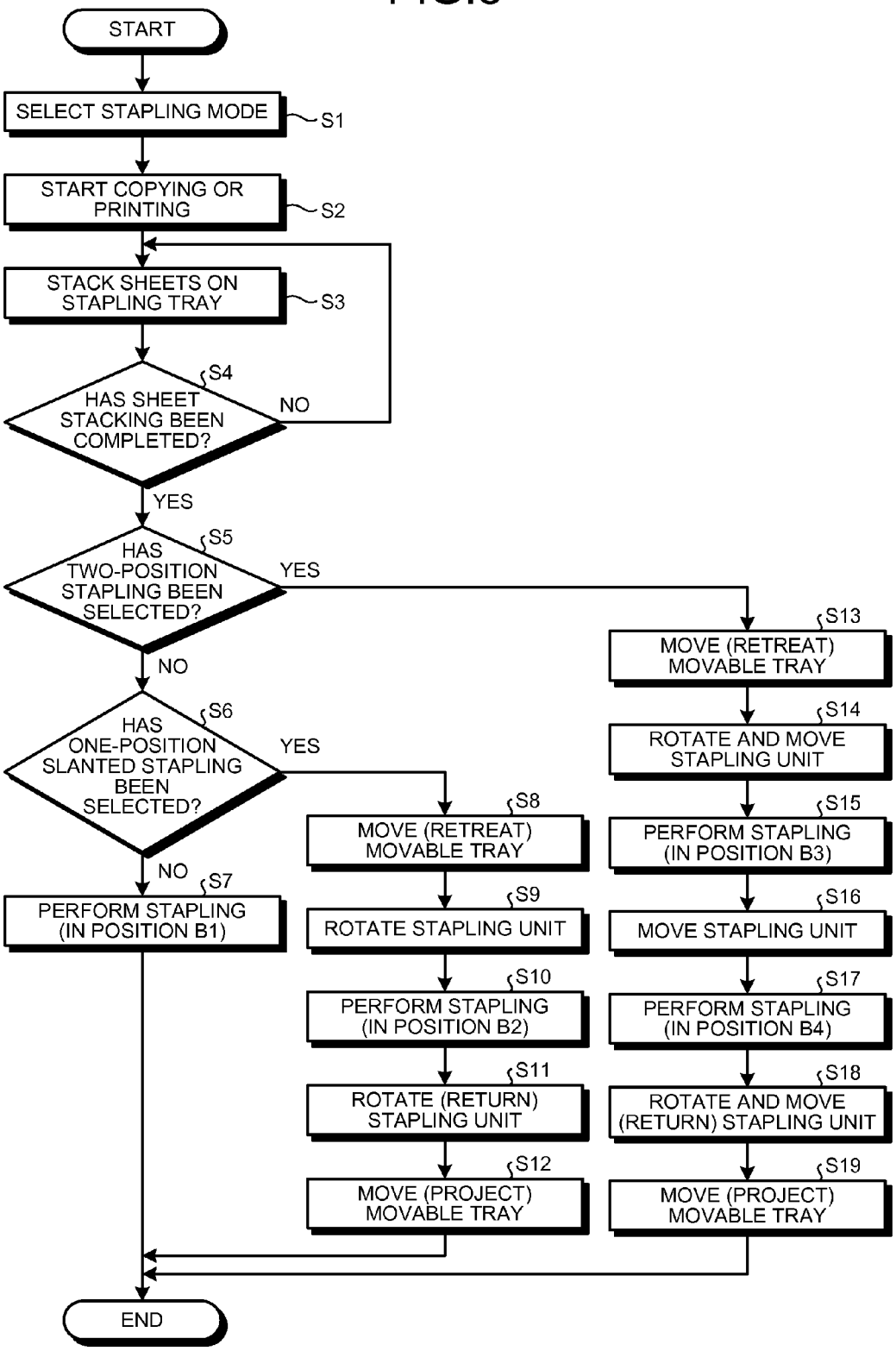
FIG. 8 is a flowchart illustrating a control procedure for a stapling operation to be performed by the sheet finishing device (sheet processing device)

FIG. 8 is a flowchart illustrating a control procedure for the stapling operation to be performed by the sheet finishing apparatus according to the present embodiment.

Referring to FIG. 8, when the stapling operation is started, first, an operator selects a staple mode and sets the number of sheets in a bundle of sheets to be stapled from the operation control section 440 of the image forming apparatus 100 (Step S1). Thereafter, copying or printing is started (Step S2). The sheet finishing apparatus 200 receives sheets, on which images are formed, conveys the sheets to the staple tray 219, and stacks the sheets on the staple tray 219 (Step S3).

Subsequently, whether the preset number of sheets has been stacked is determined (Step S4). At a time point when the preset number of sheets has been stacked (Yes at Step S4), the staple mode is confirmed (Step S5). In this example, it is judged whether the two-position stapling is selected. If it is judged the two-position stapling is not selected (No at Step S5), the staple mode is confirmed again (Step S6). In this example, it is judged whether the one-position slanted stapling is selected (Step S6). If it is judged the one-position slanted stapling is not selected (No at Step S6), it is judged the one-position parallel stapling is selected. Accordingly, a stapling position is set to B1, stapling is performed at the position B1 (Step S7), and process control exits the process.

If it is judged at Step S6 that the one-position slanted stapling is selected (Yes at Step S6), the movable tray 226*b* is retreated to the position (minimum retreat) where interference with the staple unit 215 does not occur as described above (Step S8), and the staple unit is rotated on the rotating stage 222 to be situated 45 degrees relative to rear end of the sheets (a position illustrated by FIG. 7B) (Step S9). The staple unit 215 performs stapling at the position B2 to which the staple unit 215 is rotated (Step S10). Thus, the slanted stapling is performed. After completion of the stapling, the staple unit 215 is rotated in the opposite direction to bring back the staple unit 215 to the home position (a position illustrated by FIG. 7A) (Step S11). The movable tray 226*b* is moved to project to return to its initial state where sheets are to be stacked thereon (Step S12).

If it is judged at Step S5 that the two-position stapling is selected (Yes at Step S5), the movable tray 226*b* is retreated to the position (maximum retreat) where interference with the staple unit 215 does not occur in the course of traveling of the staple unit 215 as described above (Step S13), thereby withdrawing the movable tray 226*b* from the motion space of the staple unit 215. The staple unit is horizontally rotated on the rotating stage 222 90 degrees from the initial position (a position illustrated by FIG. 7A), and further moved to the stapling position B3 (a position illustrated by FIG. 7C) (Step S14). The position to which the staple unit is to travel is individually set depending on a sheet size.

The staple unit 215 performs a first stapling of the two-position stapling at position B3 (Step S15). Furthermore, the staple unit 215 is moved along the rear end of the sheet in the motion space to the position B4 which is a second stapling position (Step S16) and performs a second stapling at the position B4 (Step S17).

After the two-position stapling is completed, the staple unit 215 is moved in the direction opposite to that at Steps S14 and S16, and further rotated in the opposite direction to that at Steps S14 and S16, thereby bringing the staple unit 215 back to the home position (Step S18). Thereafter, the movable tray 226*b* is returned to the position for stacking sheets (Step S19), and process control exits the process.

Figure 9A:
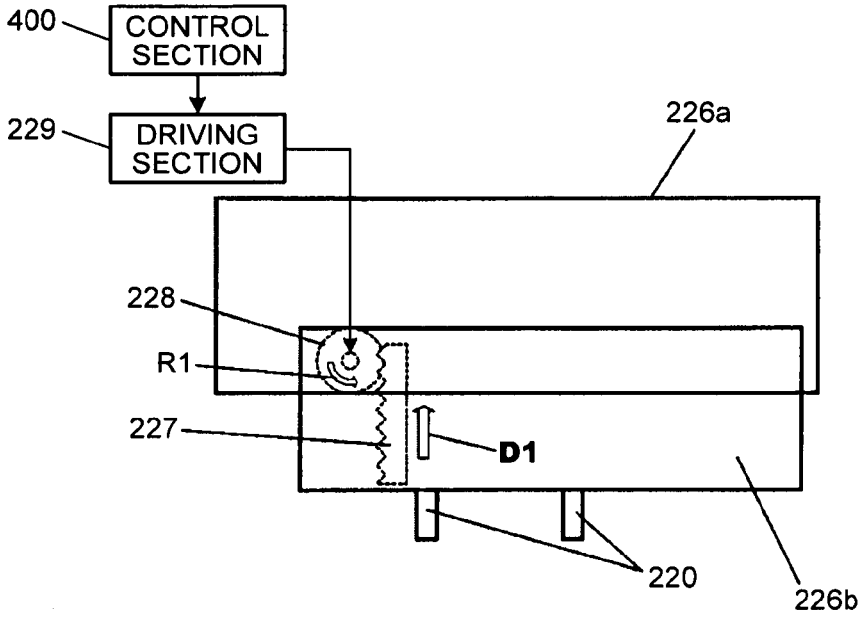
FIGS. 9A and 9B are explanatory diagrams illustrating a driving mechanism for a movable tray.
Figure 9B:
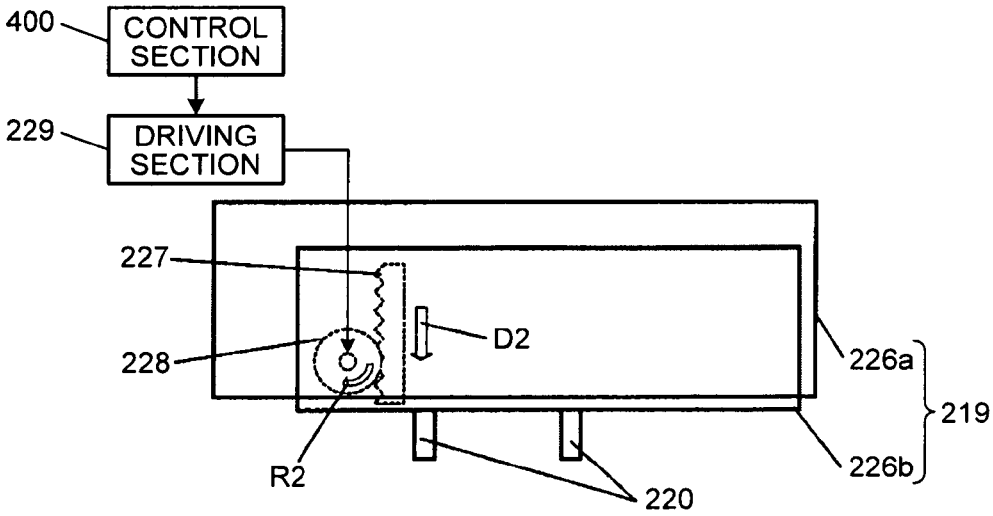

FIGS. 9A and 9B are explanatory diagrams illustrating a driving mechanism for the movable tray. FIG. 9A illustrates a state where the movable tray 226*b* maximally projects from the fixed tray 226*a*, while FIG. 9B illustrates a state where the movable tray 226*b* is maximally withdrawn under the fixed tray 226*a*.

As illustrated in FIGS. 9A and 9B, the rack 227 is mounted on a backside of the movable tray 226*b*. The movable tray 226*b* is configured to mesh with the gear 228 that can be rotated by the driving section 229 so that the movable tray 226*b* can be reciprocated by a driving force supplied from the driving section 229. The driving section 229 uses a motor and transmits a driving force of the motor to the gear 228, causing the gear 228 to rotate. This rotary driving force is converted by the rack 227 into linear, reciprocating motion. The driving section 229 is controlled by the control section 400 of the sheet processing device 200 illustrated in FIG. 4.

To move the movable tray 226*b*, the CPU 401 of the control section 400 activates the motor of the driving section 229, thereby rotating the gear 228. When the gear 228 is rotated, the rack 227 is linearly moved parallel to the sheet conveying direction. Together with the rack 227, the movable tray 226*b* is moved. In the example illustrated in FIG. 9A, when the gear 228 is rotated counterclockwise (arrow D1), the movable tray 226*b* is moved in a direction (direction indicated by arrow D1) where the movable tray 226*b* and the fixed tray 226*a* overlap. Put another way, the movable tray 226*b* is withdrawn from the stapling motion space.

In contrast, when the gear 228 is rotated clockwise (arrow R2), the movable tray 226*b* is moved in a direction (direction indicated by arrow D2) projecting from the fixed tray 226*a*. Put another way, the movable tray 226*b* projects into the stapling motion space. Meanwhile, the driving section 229 can employ, for instance, a mechanism in which traveling of the staple unit 215 causes a lever that is to be caught by the staple unit 215 or a mechanism ganged with the staple unit 215 to rotate, causing the lever or a driving-force transmitting member to rotate the gear 228. When a mechanism such as that described above is employed, a driving mechanism for moving the staple unit 215 can also serve as the driving section 229, making it possible to reduce the number of driving sources.

As described above, according to the present embodiment, advantages including the following are yielded.

1) The device can be downsized because of shared use of a same space as the space necessary for stacking sheets on the staple tray 219 and as the motion space for the staple unit 215.

2) The staple tray 219 includes the two trays, or, more specifically, the fixed tray 226*a* and the movable tray 226*b*, in which only the movable tray 226*b* is configured to be movable. This makes it possible to implement telescopic feature of the staple tray simply and inexpensively.

3) The alignment roller 211 is brought into contact with a sheet on the top surface of the fixed tray 226*a*. This allows the staple tray to have sufficient strength against a pressing force exerted by the alignment roller 211 when the alignment roller 211 abuts on the sheet, and sheet alignment to be performed reliably.

4) When the staple unit 215 moves into the motion space, the movable tray 226*b* is withdrawn to the outside of the motion space A (in the example described above, to the side of the fixed tray 226*a*). This allows shared use of the same space as the space necessary for stacking sheets on the staple tray 219 and as the motion space for the staple unit 215. Accordingly, the device can be downsized.

5) The sheet stacking surface of the fixed tray 226*a* and that of the movable tray 226*b* are identical in the level. Therefore, no step is produced at a bottom surface of stacked sheets, making it possible to provide favorable sheet alignment accuracy.

6) The stapling moving motor 223 that causes the staple unit 215 to travel functions as the driving source of the driving section 229 that causes the movable tray 226*b* to be elongated and shortened. Accordingly, further cost reduction and downsizing of the apparatus can be made.

7) In a case when the one-position parallel stapling is to be performed in a corner portion of a bundle of sheets, stapling can be performed at the same position where the bundle of sheets has been stacked. Accordingly, time that might otherwise be spent to move and withdraw the movable tray 226*b* becomes unnecessary, and productivity can be increased.

8) Sheet alignment is performed, irrespective of the size of sheets to be stacked, with reference to the fixed portion 212*a* of the jogger fence 212 arranged on the side where the staple unit 215 is positioned during sheet stacking. Accordingly, stapling can be performed at the same position for every sheet size without position adjustment, and productivity can be increased.

9) The overall size of the sheet processing device 200 is reduced. This can contribute also to downsizing of the overall image forming apparatus.

According to an aspect of the present invention, downsizing of the device can be achieved while providing a space necessary for a staple unit to travel and providing, on a stacking unit, a sheet stacking area necessary to satisfy sheet alignment accuracy.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device comprising:

a stacking unit configured to stack thereon one or more conveyed sheets;

a staple unit configured to staple a bundle of sheets stacked on the stacking unit;

a moving unit configured to move the staple unit to a staple position; and a projecting and retrieving unit configured to project and retrieve the stacking unit in a space overlapped with a motion space for the staple unit to move therein, wherein:

the stacking unit includes a fixed tray and a movable tray, the projecting and retrieving unit projects and retrieves the movable tray along the fixed tray, the projecting and retrieving unit retrieves the movable tray from the motion space, in order to move the staple unit by the moving unit, and the moving unit as well as the projecting and retrieving unit are driven by the same drive source.

2. The sheet processing device according to claim 1, further comprising:

a first alignment unit configured to align the delivered sheets in a sheet conveying direction by abutting with an end of sheets stacked on the stacking unit; and an abut member configured to move the delivered sheets to abut with the first alignment unit, wherein the abut member abuts with the sheet on a surface of the fixed tray to move the same.

3. The sheet processing device according to claim 2, further comprising a second alignment unit including a movable portion configured to move toward a direction orthogonal to the sheet conveying direction in order to align the sheets, wherein the position which corresponds to the first staple position is set on the basis of a fixed portion of the second alignment unit.

4. The sheet processing device according to claim 1, wherein a level of stacked sheets on the movable tray is the same as that of the fixed tray.

5. The sheet processing device according to claim 1, wherein the moving unit disposes the staple unit at a position which corresponds to a first staple position located outside of the motion space, while the sheet is stacked on the stacking unit.

6. An image forming system comprising:

a sheet processing device; and an image forming apparatus configured to form an image on a sheet, wherein the sheet processing device includes:

a stacking unit configured to stack thereon one or more conveyed sheets;

a staple unit configured to staple a bundle of sheets stacked on the stacking unit;

a moving unit configured to move the staple unit to a staple position; and a projecting and retrieving unit configured to project and retrieve the stacking unit in a space overlapped with a motion space for the staple unit to move therein, wherein:

the stacking unit includes a fixed tray and a movable tray, the projecting and retrieving unit projects and retrieves the movable tray along the fixed tray, the projecting and retrieving unit retrieves the movable tray from the motion space, in order to move the staple unit by the moving unit, and the moving unit as well as the projecting and retrieving unit are driven by the same drive source.

7. The image forming system according to claim 6, wherein the sheet processing device is arranged in a space of the image forming apparatus.

8. The image forming system according to claim 6, further comprising:

a first alignment unit configured to align the delivered sheets in a sheet conveying direction by abutting with an end of sheets stacked on the stacking unit; and an abut member configured to move the delivered sheets to abut with the first alignment unit, wherein the abut member abuts with the sheet on a surface of the fixed tray to move the same.

9. The image forming system according to claim 8, further comprising a second alignment unit including a movable portion configured to move toward a direction orthogonal to the sheet conveying direction in order to align the sheets, wherein the position which corresponds to the first staple position is set on the basis of a fixed portion of the second alignment unit.

10. The image forming system according to claim 6, wherein a level of stacked sheets on the movable tray is the same as that of the fixed tray.

11. The image forming system according to claim 6, wherein the moving unit disposes the staple unit at a position which corresponds to a first staple position located outside of the motion space, while the sheet is stacked on the stacking unit.

12. A sheet processing method capable of realizing one-position parallel stapling, one-position slanted stapling, and two-position stapling, implemented by a sheet processing device which includes: a stacking unit configured to stack thereon one or more conveyed sheets; a staple unit configured to staple a bundle of sheets stacked on the stacking unit; a moving unit configured to move the staple unit to a staple position; and a projecting and retrieving unit configured to project and retrieve the stacking unit in a space overlapped with a motion space for the staple unit to move therein, wherein the stacking unit includes a fixed tray and a movable tray, the projecting and retrieving unit projects and retrieves the movable tray along the fixed tray, the projecting and retrieving unit retrieves the movable tray from the motion space, in order to move the staple unit by the moving unit, and the moving unit as well as the projecting and retrieving unit are driven by the same drive source, the method comprising:

projecting maximally the stacking unit by the projecting and retrieving unit, and disposing the staple unit at a first staple position located outside of the motion space, when stacking the sheets on the stacking unit;

stapling the bundle of sheets at the first staple position, after projecting maximally the stacking unit and disposing the staple unit at the first staple position, if the one-position parallel stapling is to be performed;

rotating the staple unit by an angle corresponding to a staple angle for the slanted stapling, retrieving the stacking unit by the projecting and retrieving unit to a position where the stacking unit does not hinder a rotation of the staple unit, and stapling the bundle of sheets at a second staple position, after projecting maximally the stacking unit and disposing the staple unit at the first staple position, if the one-position slanted stapling is to be performed;

rotating the staple unit to a position where a staple needle of the staple unit becomes parallel to a rear end of the bundle of sheets, retrieving the staple unit maximally by the projecting and retrieving unit to a position where the stacking unit does not hinder the motion of the staple unit, and stapling the bundle of sheets at a third staple position and a fourth staple position, after projecting maximally the stacking unit and disposing the staple unit at the first staple position, if the two-position stapling is to be performed.

* * * * *